US007737920B2

(12) United States Patent
Cho et al.

(10) Patent No.: US 7,737,920 B2
(45) Date of Patent: Jun. 15, 2010

(54) PLASMA DISPLAY APPARATUS

(75) Inventors: Janghwan Cho, Seoul (KR); Hyuoil Park, Seongnam-si (KR); Changjoon Park, Seoul (KR); Sunghwan Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 515 days.

(21) Appl. No.: 11/844,202

(22) Filed: Aug. 23, 2007

(65) Prior Publication Data

US 2008/0048572 A1 Feb. 28, 2008

(30) Foreign Application Priority Data

Aug. 23, 2006 (KR) ..... 10-2006-0080142

(51) Int. Cl.
*G09G 3/28* (2006.01)

(52) U.S. Cl. ..... 345/63; 345/60

(58) Field of Classification Search ..... 345/60, 345/63, 66; 315/169.4; 313/567
See application file for complete search history.

(56) References Cited

U.S. PATENT DOCUMENTS 7,667,696 B2 * 2/2010 Jang et al. ..... 345/208
2006/0001609 A1 * 1/2006 Moon ..... 345/67
2006/0267876 A1 * 11/2006 Jang et al. ..... 345/68
2007/0046584 A1 * 3/2007 Jung et al. ..... 345/68

FOREIGN PATENT DOCUMENTS

KR 10-2005-0112851 A 12/2005
KR 10-2005-0113858 A 12/2005

* cited by examiner

*Primary Examiner*—Ricardo L Osorio
(74) *Attorney, Agent, or Firm*—Birch, Stewart, Kolasch & Birch, LLP

(57) ABSTRACT

A plasma display apparatus is disclosed. The plasma display apparatus includes a plasma display panel including a scan electrode, a sustain electrode, and an address electrode to intersect the scan electrode and the sustain electrode, an integrated driver for supplying the scan electrode or the sustain electrode with a sustain voltage, a data driver for supplying the address electrode with a data voltage, a first ground unit for grounding the integrated driver and the sustain electrode, a second ground unit for grounding the data driver, and a ground controller for controlling the first ground unit and the second ground unit to be electrically separated from each other for a predetermined period in at least one of a reset period and an address period of a subfield.

18 Claims, 9 Drawing Sheets

PLASMA DISPLAY APPARATUS

This application claims the benefit of Korean Patent Application No. 10-2006-0080142 filed on Aug. 23, 2006, which is hereby incorporated by reference.

BACKGROUND OF THE DISCLOSURE

1. Field of the Disclosure

This document relates to a display apparatus, and more particularly, to a plasma display apparatus.

2. Related Art

In general, a plasma display apparatus comprises a plasma display panel (PDP) on which images are displayed, and a driver configured to drive the PDP and attached to a rear surface of the PDP.

In general, a PDP comprises a front panel and a rear panel. A barrier rib formed between the front panel and the rear panel forms one unit discharge cell. Each cell is filled with an inert gas containing a primary discharge gas, such as neon (Ne), helium (He) or a mixed gas of Ne+He, and a small amount of xenon (Xe). A plurality of the unit discharge cell constitutes one pixel. For example, a red (R) cell, a green (G) cell, and a blue (B) cell form one pixel.

When the unit discharge cell is applied with a high frequency voltage and is thus discharged, the inert gas generates vacuum ultraviolet rays. The vacuum ultraviolet rays excite phosphors formed between the barrier ribs to implement images.

The PDP comprises a plurality of electrodes, such as scan electrodes Y, sustain electrodes Z, and address electrodes X. Drivers for applying driving voltages to the electrodes of the PDP are connected to the respective electrodes.

The respective drivers supply driving pulses to the electrodes of the PDP in predetermined periods, for example, a reset pulse in a reset period, a scan pulse in an address period, and a sustain pulse in a sustain period, when the PDP is driven, so that images are implemented. This plasma display apparatus can be made thin and light, and has thus been in the spotlight as the next-generation display apparatus.

Meanwhile, a connection structure and operating characteristics of the drivers for driving the plasma display apparatus are important factors to have an effect on driving characteristics of the plasma display apparatus. Accordingly, research has been continuously performed on the production of a plasma display apparatus with a higher quality.

SUMMARY OF THE DISCLOSURE

In one aspect, a plasma display apparatus comprises a plasma display panel comprising a scan electrode and a sustain electrode, and an address electrode to intersect the scan electrode and the sustain electrode, an integrated driver for supplying the scan electrode or the sustain electrode with a sustain voltage, a data driver for supplying the address electrode with a data voltage, a first ground unit for grounding the integrated driver and the sustain electrode, a second ground unit for grounding the data driver, and a ground controller for controlling the first ground unit and the second ground unit to be electrically separated from each other for a predetermined period in at least one of a reset period and an address period of a subfield.

The integrated driver may have one end connected to the scan electrode and the other end commonly connected to the first ground unit, the sustain electrode, and one end of the ground controller.

The data driver may have one end connected to the address electrode and the other end commonly connected to the second ground unit and the other end of the ground controller.

The ground controller may have one end commonly connected to the other end of the integrated driver, the first ground unit, and the sustain electrode, and the other end connected to the second ground unit, the other end of a bottom switch of the data driver, and the other end of a data voltage supply unit of the data driver.

The ground controller may comprise a switch element, and a parasitic capacitor that is generated by the switch element.

The switch element may comprise two switch elements having body diodes.

The body diodes may have anodes or cathodes connected to each other.

The ground controller may be turned off for a predetermined period in the reset period of the subfield, so that the first ground unit is separated from the second ground unit.

The ground controller may be turned on for a predetermined period in the address period and the sustain period of the subfield, so that the first ground unit and the second ground unit are connected to each other.

In the reset period, a waveform of the address electrode may be similar to a rest waveform of the scan electrode.

In the reset period, a highest value of the waveform of the address electrode may be substantially the same as that of the data voltage.

The ground controller may be turned off for a predetermined period in the address period of the subfield, separating the first ground unit and the second ground unit from each other. The ground controller may be turned on in a period where a positive sustain voltage is applied, of the sustain period of the subfield, connecting the first ground unit and the second ground unit, and may be turned off in the remaining periods, separating the first ground unit and the second ground unit from each other.

In the sustain period, a waveform of the address electrode may be similar to a sustain waveform of the scan electrode.

In the sustain period, a highest value of the waveform of the address electrode may be substantially the same as that of the data voltage.

The ground controller may be turned on in the address period of the subfield, connecting the first ground unit and the second ground unit. The ground controller may be turned on in a period where a positive sustain voltage is applied, of the sustain period of the subfield, connecting the first ground unit and the second ground unit, and may be turned off in the remaining periods, separating the first ground unit and the second ground unit from each other.

In the sustain period, a waveform of the address electrode may be similar to a sustain waveform of the scan electrode.

In the sustain period, a highest value of the waveform of the address electrode may be substantially the same as that of the data voltage.

The ground controller may be turned on in the reset period and the sustain period of the subfield, connecting the first ground unit and the second ground unit, and may be turned off in the address period of the subfield, separating the first ground unit and the second ground unit from each other.

BRIEF DESCRIPTION OF THE DRAWINGS

The accompanying drawings, which are included to provide a further understanding of the invention and are incorporated on and constitute a part of this specification, illustrate embodiments of the invention and together with the description serve to explain the principles of the invention. In the drawings.

DETAILED DESCRIPTION OF EMBODIMENTS

Hereinafter, implementations of this document will be described in detail with reference to the attached drawings.

Figure 1:
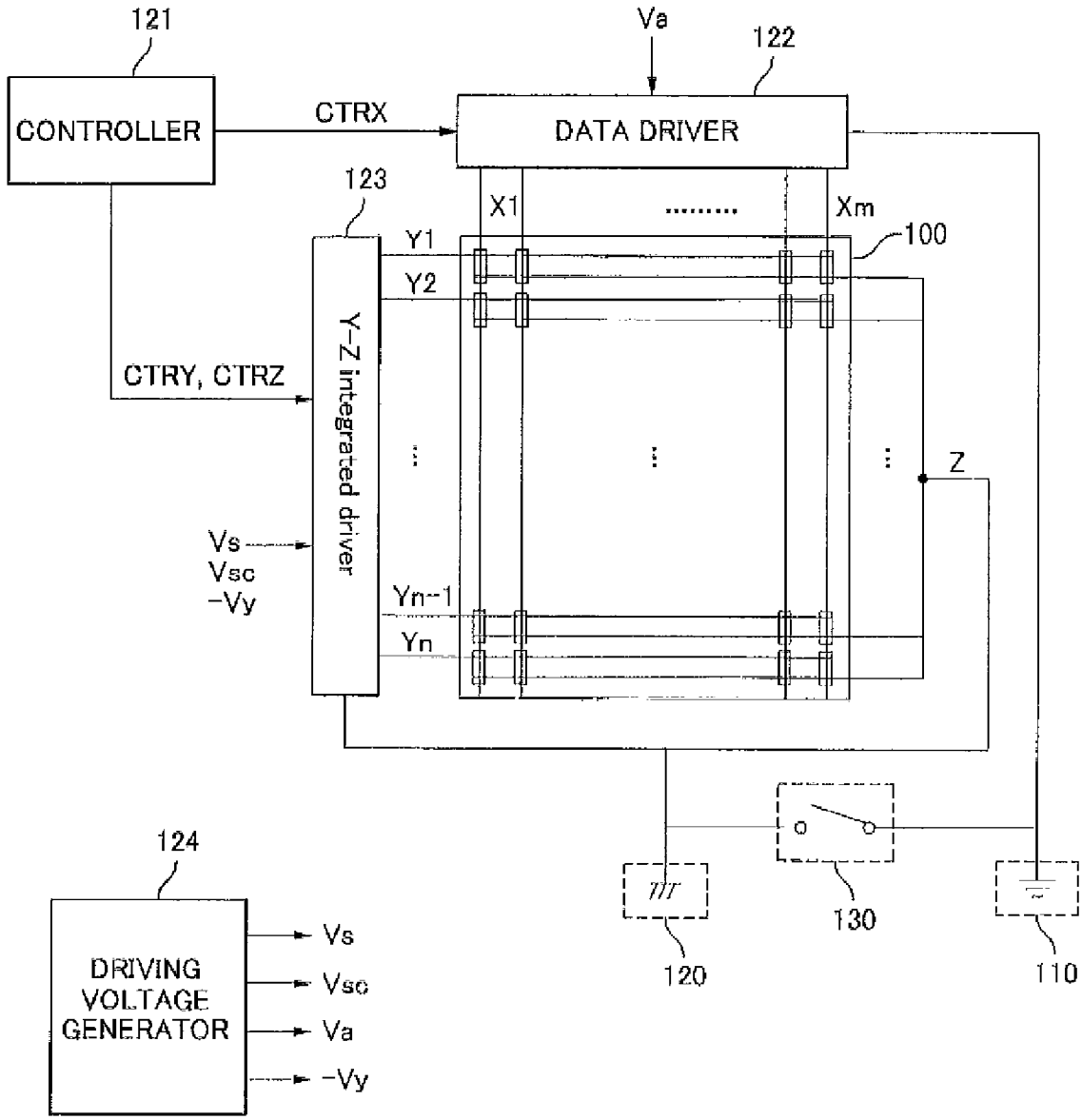
FIG. 1 is a view illustrating an example of a plasma display apparatus in accordance with this document.

FIG. 1 is a view illustrating an example of a plasma display apparatus in accordance with this document.

As shown in FIG. 1, the plasma display apparatus in accordance with an embodiment of this document comprises a PDP 100, drivers 122 and 123 for driving electrodes formed in the PDP 100, a controller 121 for controlling the drivers 122 and 123, and a driving voltage generator 124 for supplying driving voltages necessary for the drivers 122 and 123. A first ground unit 120, a second ground unit 110, and a ground controller 130 are described later on.

The drivers comprise a data driver 122 for supplying data to data electrodes X1 to Xm, and a Y-Z integrated driver 123 for driving both the scan electrodes Y1 to Yn and the sustain electrode Z.

The PDP 100 has a front substrate (not shown) and a rear substrate (not shown) coalesced together at a predetermined distance. For instance, a number of electrodes, such as scan electrodes Y1 to Yn and a sustain electrode Z, are formed in pairs in the front substrate. Data electrodes X1 to Xm to intersect the scan electrodes Y1 to Yn and the sustain electrode Z are formed in the rear substrate.

Figure 2:
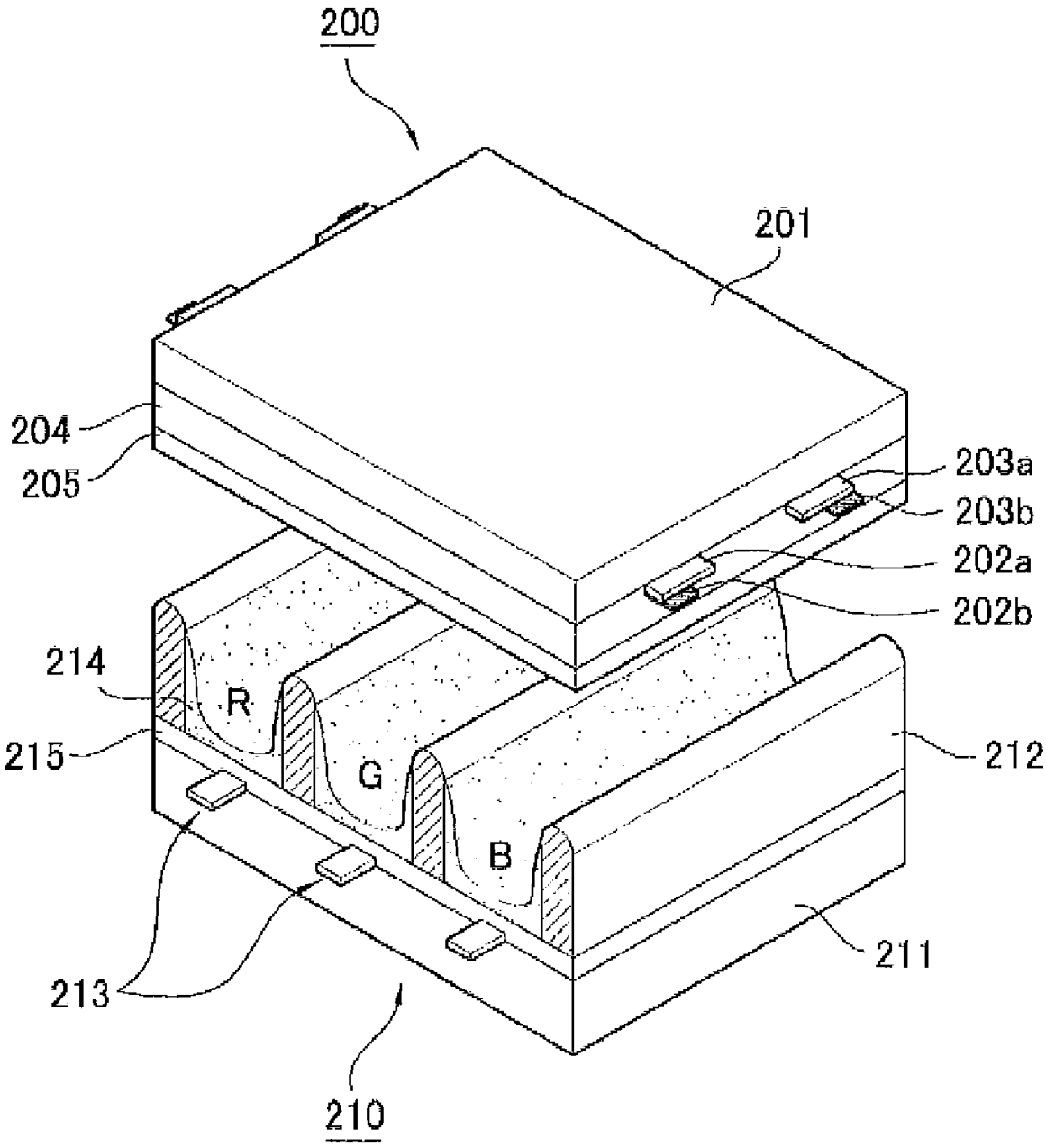
FIG. 2 is a view illustrating an example of a PDP construction in accordance with this document.

FIG. 2 is a view illustrating an example of a PDP construction in accordance with this document.

As shown in FIG. 2, the PDP can comprise, for example, a front panel 200 and a rear panel 210, which are coupled together in parallel with a predetermined distance therebetween. In the front panel 200, a plurality of sustain electrode pairs, which is comprised of pairs of a scan electrode 202, Y and a sustain electrode 203, Z, are arranged in a front substrate 201 serving as a display surface on which images are displayed. In the rear panel 210, a plurality of address electrodes 213, Z to intersect the plurality of sustain electrode pairs are arranged on a rear substrate 211 serving as a rear surface.

The front panel 200 can comprise the pairs of the scan electrodes 202, Y and the sustain electrodes 203, Z for mutually discharging the other within one discharge cell and sustaining the emission of the cell. In other words, the scan electrode 202, Y and the sustain electrode 203, Z can comprises transparent electrodes 202*a* and 203*a*, made of a transparent ITO material, and bus electrodes 202*b* and 203*b*, made of a metal material. Alternatively, the scan electrode 202, Y and the sustain electrode 203, Z may comprise the transparent electrodes 202*a* and 203*a* or the bus electrodes 202*b* and 203*b*. The scan electrode 202, Y and the sustain electrode 203, Z are covered with one or more upper dielectric layers 204 for limiting a discharge current and providing insulation between the electrode pairs. A protection layer 205 on which, for example, magnesium oxide (MgO) is deposited is formed on the upper dielectric layers 204 in order to facilitate the discharge.

Barrier ribs 212 having a stripe type or a well type, for forming, for example, a plurality of discharge spaces (i.e., discharge cells), are arranged in parallel in the rear panel 210. Further, the plurality of address electrodes 213, Z that generate vacuum ultraviolet rays by performing an address discharge are disposed in parallel to the barrier ribs 212. R, C, and B phosphors 214 that emit a visible ray for displaying images during the address discharge are coated on an upper surface of the rear panel 210. A lower dielectric layer 215 for protecting the address electrodes 213, Z is formed between the address electrodes 213, Z and the phosphors 214.

The front panel 200 and the rear panel 210 are coalesced together through a sealing process, forming the PDP. To the PDP is attached drivers for driving a plurality of electrodes, such as the scan electrode 202, Y, the sustain electrode 203, Z, and the address electrode 213, X, and so on, thus forming the plasma display apparatus.

Figure 3:
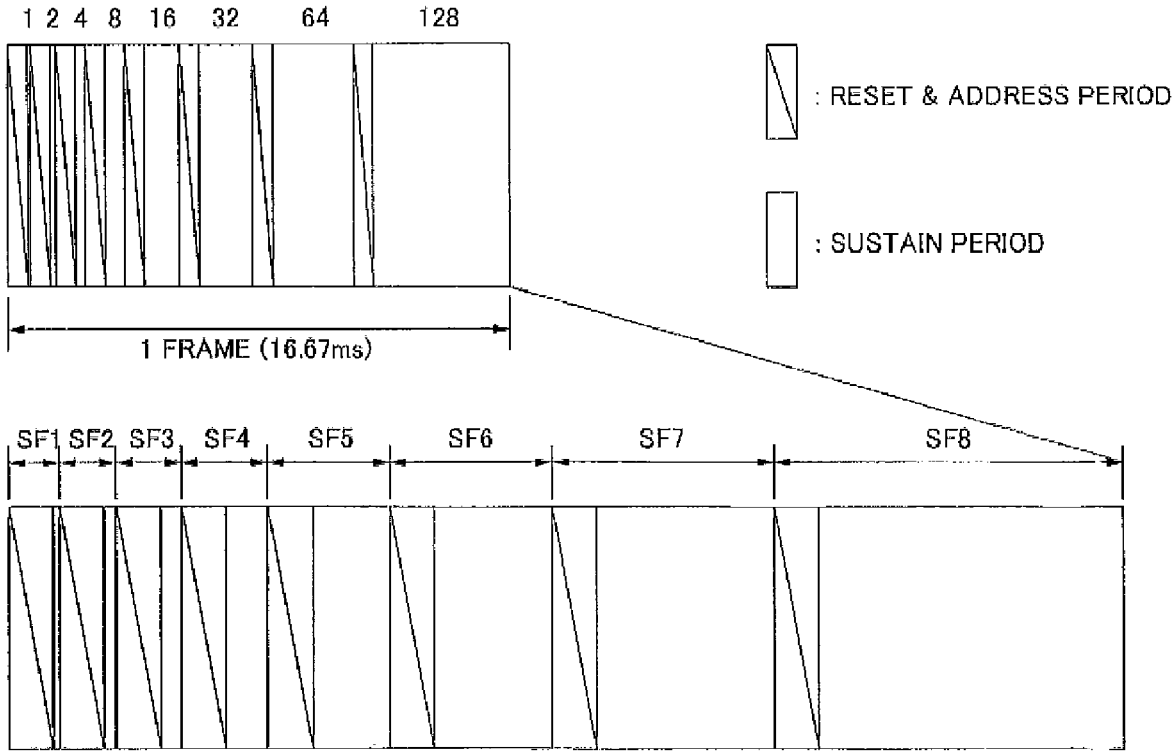
FIG. 3 is a view illustrating an example of a method of driving the plasma display apparatus in accordance with this document.

FIG. 3 is a view illustrating an example of a method of driving the plasma display apparatus in accordance with this document.

Referring to FIG. 3, in order to implement images on the PDP, the plasma display apparatus in accordance with an embodiment of this document can be driven with one frame being divided into a plurality of subfields. For example, each subfield can be divided into a reset period for resetting the whole cells, an address period for selecting a cell to be discharged, and a sustain period for implementing gray levels according to the number of discharges.

For example, if it is sought to display images with 256 gray levels, a frame period (16.67 ms) corresponding to 1/60 seconds is divided into plural subfields (for example, eight subfields SF1 to SF8). Each of the eight subfields SF1 to SF8 is divided into a reset period RP, an address period AP, and a sustain period SP as described above. In this case, the reset period RP and the address period AP of each subfield are the same every subfield, whereas the sustain period SP and the number of sustain pulses allocated thereto may be varied For example, they may be increased in the ratio of $2^n$ (where, n=0, 1, 2, 3, 4, 5, 6, 7) in each subfield in order to represent gray levels.

An example of a basic panel structure of the plasma display apparatus and an example of the driving method of implementing images have been described as above. Hereinafter, an example of the plasma display apparatus in accordance with an embodiment of this document is further described with reference to FIG. 1.

The integrated driver 123 supplies reset pulses for resetting a wall charge state of the whole discharge cells in a previous subfield, such as a set-up pulse (i.e., a ramp-up waveform) and a set-down pulse (i.e., a ramp-down waveform), to the scan electrode Y1 to Yn during the reset period under the control of the controller 121.

Further, the integrated driver 123 sequentially supplies a scan pulse of a scan voltage −Vy to the scan electrodes Y1 to Yn while sustaining a scan bias voltage Vsc during the address period under the control of the controller 121.

Furthermore, the integrated driver 123 may apply a sustain pulse to the scan electrodes Y1 to Yn during the sustain period under the control of the controller 121. In this case, the integrated driver 123 can alternately apply a positive sustain voltage Vs and a negative sustain voltage −Vs to the sustain electrodes, such as the scan electrodes, so that a sustain discharge is generated.

The data driver 122 is supplied with data, which has experienced inverse gamma correction and error diffusion through an inverse gamma correction circuit (not shown), an error diffusion circuit (not shown) and so on, and has been then mapped to respective subfields by a subfield mapping circuit. The data driver 122 samples and latches data in response to a timing control signal CTRX generated from the controller 121, and supplies the data to the address electrodes X1 to Xm. A discharge cell that is turned on/off according to the data, that is, a cell in which a sustain discharge (i.e., a display discharge) will be generated in the sustain period is selected.

If the sustain pulse is supplied to a discharge cell to which the data pulse has been supplied as described above in the sustain period to be described later, wall charges of the degree in which the sustain discharge can be generated are formed.

In this case, the first ground unit 120 that grounds the integrated driver 123 and the second ground unit 110 that grounds the data driver 122 can be electrically separated from each other.

In other words, the ground controller 130 can electrically connect or separate the first ground unit 120 and the second ground unit 110. For instance, the ground controller 130 controls the first ground unit 120 and the second ground unit 110 to be electrically separated from each other in at least one of the reset period and the address period of a subfield. This is described in detail later on with reference to the drawings subsequent to FIG. 5.

The controller 121 receives horizontal/vertical sync signals and clock signals, generates timing control signals CTRX, CTRY, and CTRZ for controlling operating timings and synchronization of the drivers 122 and 123 in the reset period, the address period, and the sustain period, and supplies the timing control signals CTRX, CTRY, and CTRZ to corresponding drivers 122 and 123, thus controlling the respective drivers.

Meanwhile, the data control signal CTRX comprises a sampling clock for sampling data, a latch control signal, and a switch control signal to control on/off time of a sustain driving circuit and a driving switch element. The scan control signal CTRY comprises a switch control signal to control on/off time of a sustain driving circuit and a driving switch element within the integrated driver 123.

The driving voltage generator 124 generates a common scan voltage Vsc, a scan voltage −Vy, a sustain voltage Vs, a data voltage Va, etc. The driving voltages may vary depending on a composition of a discharge gas or a discharge cell structure.

The construction of the plasma display apparatus described above in accordance with this document is only one example for helping understanding of this document. It is to be noted that this document is not limited to the above construction. In other words, it may be considered that a construction and operation of a driving apparatus fall within this document when they have the same construction and roles of a driver recited in claims according to this document although they are modified slightly.

Figure 4:
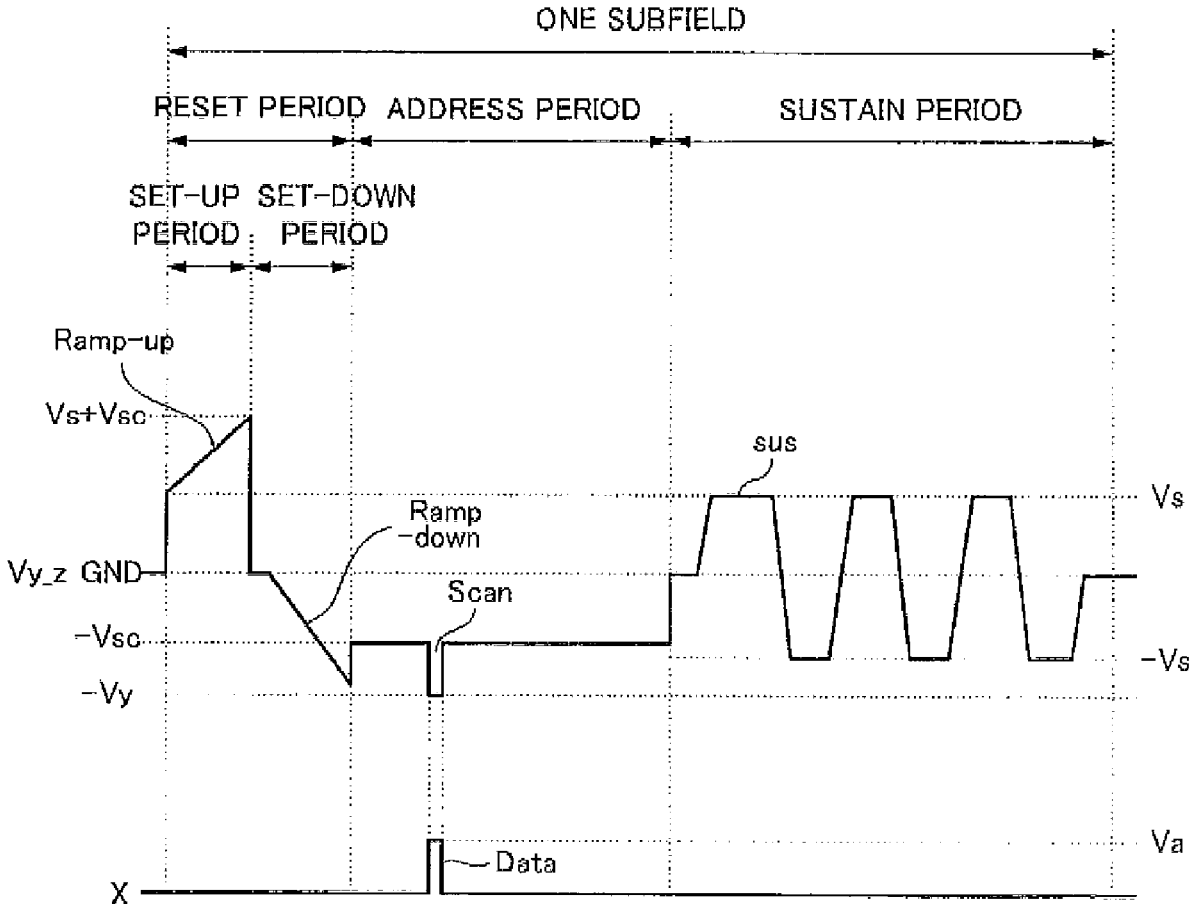
FIG. 4 is a view illustrating an example of a driving waveform of the plasma display apparatus in accordance with this document.

FIG. 4 is a view illustrating an example of a driving waveform of the plasma display apparatus in accordance with this document.

There is shown in FIG. 4 a driving waveform in one of a number of subfields, which are implemented by the plasma display apparatus in accordance with an embodiment of this document.

A subfield is divided into a reset period for resetting discharge cells of the whole screen, an address period for selecting a discharge cell, and a sustain period for implementing images by sustaining a discharge of a selected discharge cell.

In a set-up period of the reset period, a ramp-up waveform Ramp-up of a high voltage is applied to scan electrode (Y) lines at the same time. The ramp-up waveform Ramp-up causes to generate a weak discharge (a set-up discharge) within the cells of the whole screen, so that wall charges are created within the cells. The ramp-up waveform Ramp-up can be supplied as a sum of, for instance, a sustain voltage Vs and a scan reference voltage Vsc.

In a set-down period of the reset period, a ramp-down waveform Ramp-down is supplied to the scan electrode (Y) lines at the same time. The ramp-down waveform Ramp-down generates a weak erase discharge within the cells, thus making uniform wall charges of discharge cells, which have been generated and excessively accumulated by the set-up discharge.

In the address period, a scan pulse Scan having a voltage −Vy is applied to the scan electrode (Y) lines and, at the same time, a data pulse Data is supplied to address electrode (X) lines. As a voltage difference between the scan pulse Scan and the data pulse Data and a wall voltage generated in the reset period are added, an address discharge is generated within cells to which the data pulse Data has been supplied. The address discharge causes to generate wall charges within selected cells.

In the sustain period, the scan electrode Y or the sustain electrode Z are supplied with a sustain pulse SUS, so that a sustain discharge is generated. That is, the sustain pulse is supplied such that a voltage difference between the scan electrode Y and the sustain electrode Z becomes a sustain voltage, thus generating a surface discharge.

Figure 5:
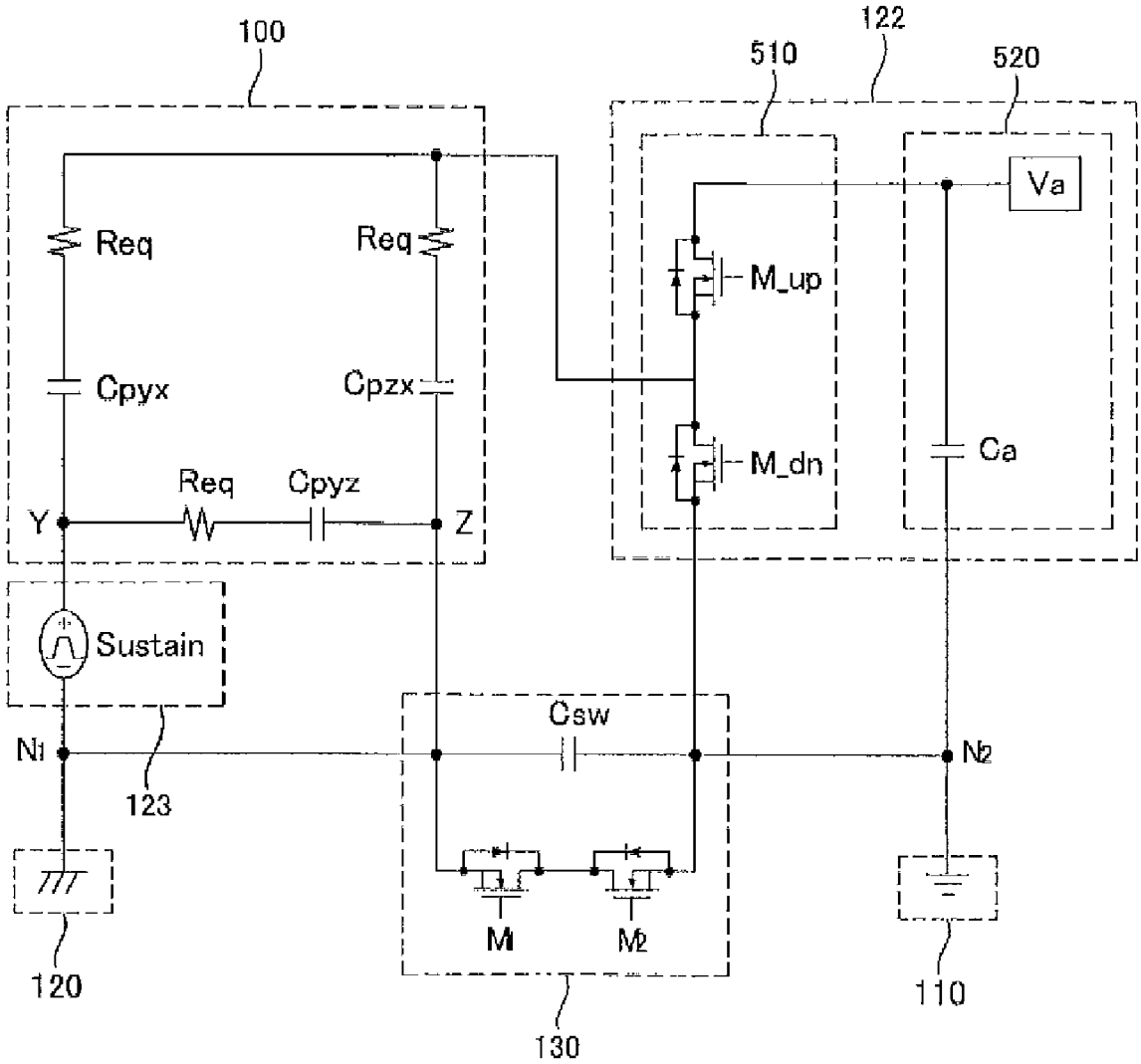
FIG. 5 is a circuit diagram schematically showing an example of a driver of the plasma display apparatus in accordance with this document.

FIG. 5 is a circuit diagram schematically showing an example of a driver of the plasma display apparatus in accordance with this document.

As shown in FIG. 5, the plasma display apparatus according to an example of this document comprises a PDP 100, an integrated driver 123, a data driver 122, and a ground controller 130.

The PDP 100 comprises a YZ capacitor Cpyz between the scan electrode Y and the sustain electrode Z, a ZX capacitor Cpzx between the sustain electrode Z and the address electrode X, a YX capacitor Cpyx between the address electrode X and the scan electrode Y, and equivalent resistors Req for the respective electrodes.

The integrated driver 123 has one end connected to the scan electrode Y, and the other end commonly connected to the first ground unit 120, the sustain electrode Z, and one end of the ground controller 130.

The integrated driver 123 can supply the scan electrode Y or the sustain electrode Z with a sustain voltage. For example, as shown in FIG. 5, the integrated driver 123 can supply the scan electrode Y with the sustain voltage.

The first ground unit 120 can ground the integrated driver 123.

The data driver 122 has one end connected to the address electrode X, and the other end commonly connected to the second ground unit 110 and the other end of the ground controller 130.

The data driver 122 can comprise a data drive IC 510 and a data voltage supply unit 520.

The data drive IC 510 comprises a top switch M_up and a bottom switch M_dn for controlling an output to the address electrode X. The top switch MN_up has one end connected to the address electrode X and the other end connected to the data voltage supply unit 520, so that it controls the data voltage supply unit 520 to supply the data voltage Va to the address electrode X. The bottom switch M_dn has one end commonly connected to the address electrode X and one end of the top switch M_up, and the other end commonly connected to the other end of the ground controller 130 and the second ground unit 110, so that it controls the second ground unit 110 to supply a ground voltage to the address electrode X.

The second ground unit 110 can ground the data driver 122.

The ground controller 130 can control the first ground unit 120 and the second ground unit 110 to be electrically separated from each other. For example, the ground controller 130 can control the first ground unit 120 and the second ground unit 110 to be electrically separated from each other in at least one of the reset period and the address period of a subfield for a predetermined period In this case, a ground voltage when the first ground unit 120 and the second ground unit 110 are separated from each other may be the same or different.

The ground controller 130 comprises switch elements and can thus separate the first ground unit 120 and the second ground unit 110 through a predetermined switching operation. The ground controller 130 comprises, for example, ground separation switches M1 and M2, and can comprise a parasitic capacitance Csw, which is parasitic and generated in the ground separation switches M1 and M2.

Furthermore, the ground separation switches M1 and M2 may be formed of, for instance, a field effect transistor device shown in FIG. 5. That is, each of the ground separation switches M1 and M2 may consist of two switching elements comprising a body diode. At this time, anodes or cathodes of the body diodes included in the two switching elements may be connected.

In FIG. 5, there is shown an equivalent circuit of, for instance, the ground controller 130 in this case.

The ground separation switches M1 and M2 have one ends commonly connected to the other end of the integrated driver 123, the first ground unit 120, and the sustain electrode Z, and the other ends connected to the second ground unit 110, the other end of the bottom switch M_dn, and the other end of the data voltage supply unit 520, so that the first ground unit 120 and the second ground unit 110 can be controlled to be separated from each other.

An operation of the ground controller 130 in accordance with an embodiment of this document is described below with reference to FIG. 6.

FIGS. 6 to 9 are views illustrating driving waveforms of the plasma display apparatus in accordance with first to fourth embodiments of this document.

Figure 6:
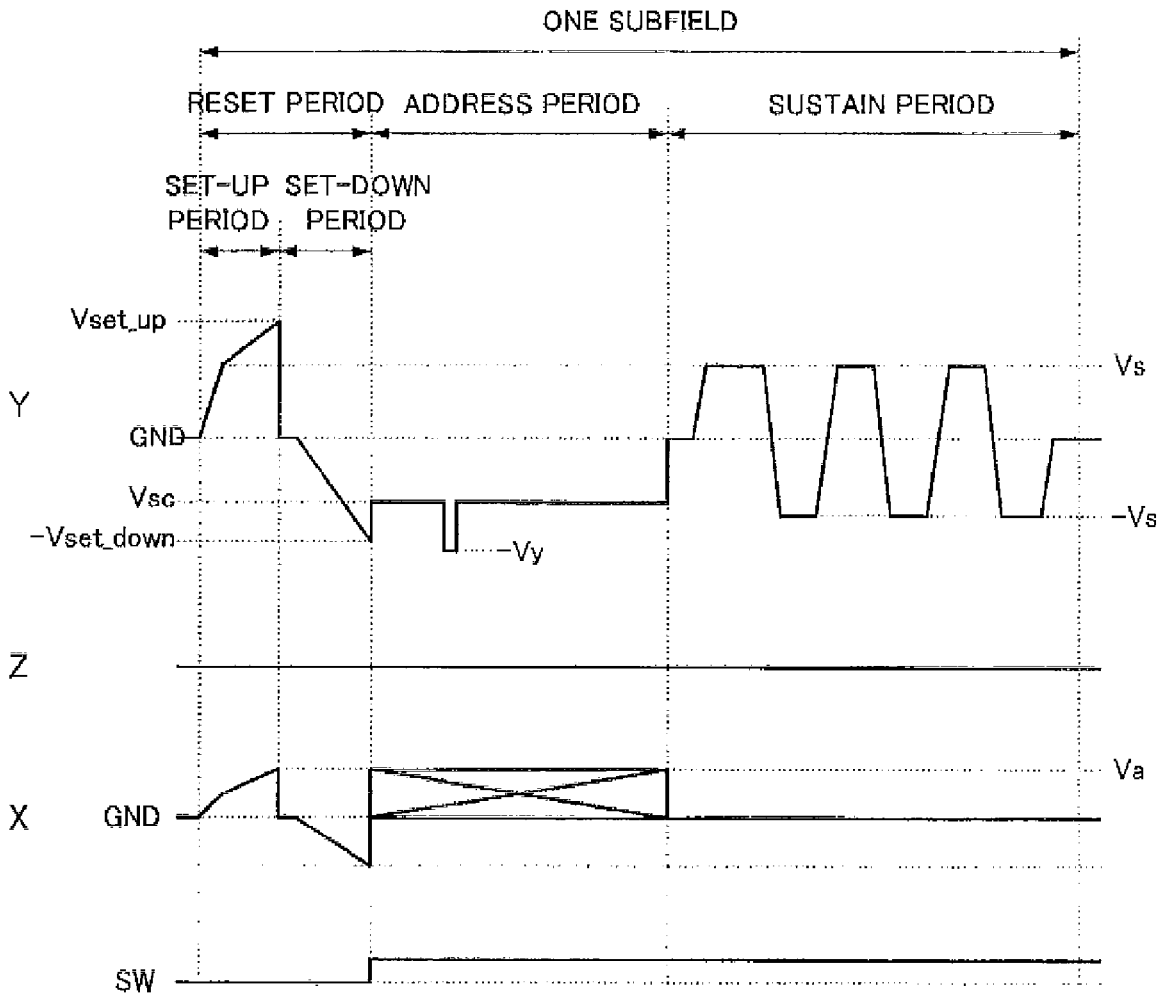
FIGS. 6 to 9 are views illustrating driving waveforms of the plasma display apparatus in accordance with first to fourth embodiments of this document.

Referring to FIG. 6, the ground controller can control the first ground unit of the scan electrode Y and the sustain electrode Z and the second ground unit of the address electrode X to be electrically separated from each other in at least one of the reset period and the address period of a subfield for a predetermined period. For example, the ground unit can be separated according to the switching operation of the switch element SW of the ground controller.

According to a first embodiment of this document, in the reset period of the subfield, the first ground unit and the second ground unit can be separated from each other by turning off the switch element SW of the ground controller, At this time, in the reset period, the address electrode X becomes a floating state, minimizing damage to the address electrode X.

In other words, if the address electrode X becomes a floating state, the address electrode X is influenced by a voltage shift of neighboring electrodes. For example, as described earlier with reference to FIG. 5, when the address electrode X becomes a floating state due to the separation of the ground unit, if a rest waveform is supplied to the scan electrode Y, a waveform having a similar shape to that of the rest waveform is also induced to the address electrode X.

As described above, the influence of a voltage shift can be minimized by floating the address electrode X. That is, the amount of an opposite voltage between the address electrode X and the scan electrode Y can be decreased and an opposite discharge can be reduced accordingly. Furthermore, a stabilized surface discharge can be generated and black luminance of the reset period can be lowered, thus improving contrast characteristics. In addition, since damage to the address electrode X can be prevented, the lifespan of phosphors can be extended and afterimages can also be improved.

In this case, the highest value of the waveform induced to the address electrode X is substantially the same as the highest value of the data voltage Va. In other words, a voltage of the floated address electrode X is changed in response to a voltage shift of neighboring electrodes. At this time, a voltage higher than the data voltage is precluded by the data voltage supply unit 520. Accordingly, the voltage rises up to only the data voltage Va induced to the address electrode X.

Furthermore, in accordance with the first embodiment of this document, in the address period and the sustain period of the subfield, the ground controller 130 is turned on to connect the first ground unit 120 and the second ground unit 110. Thus, the ground unit of the scan electrode Y and the sustain electrode Z and the ground unit of the address electrode X can be used commonly.

Figure 7:
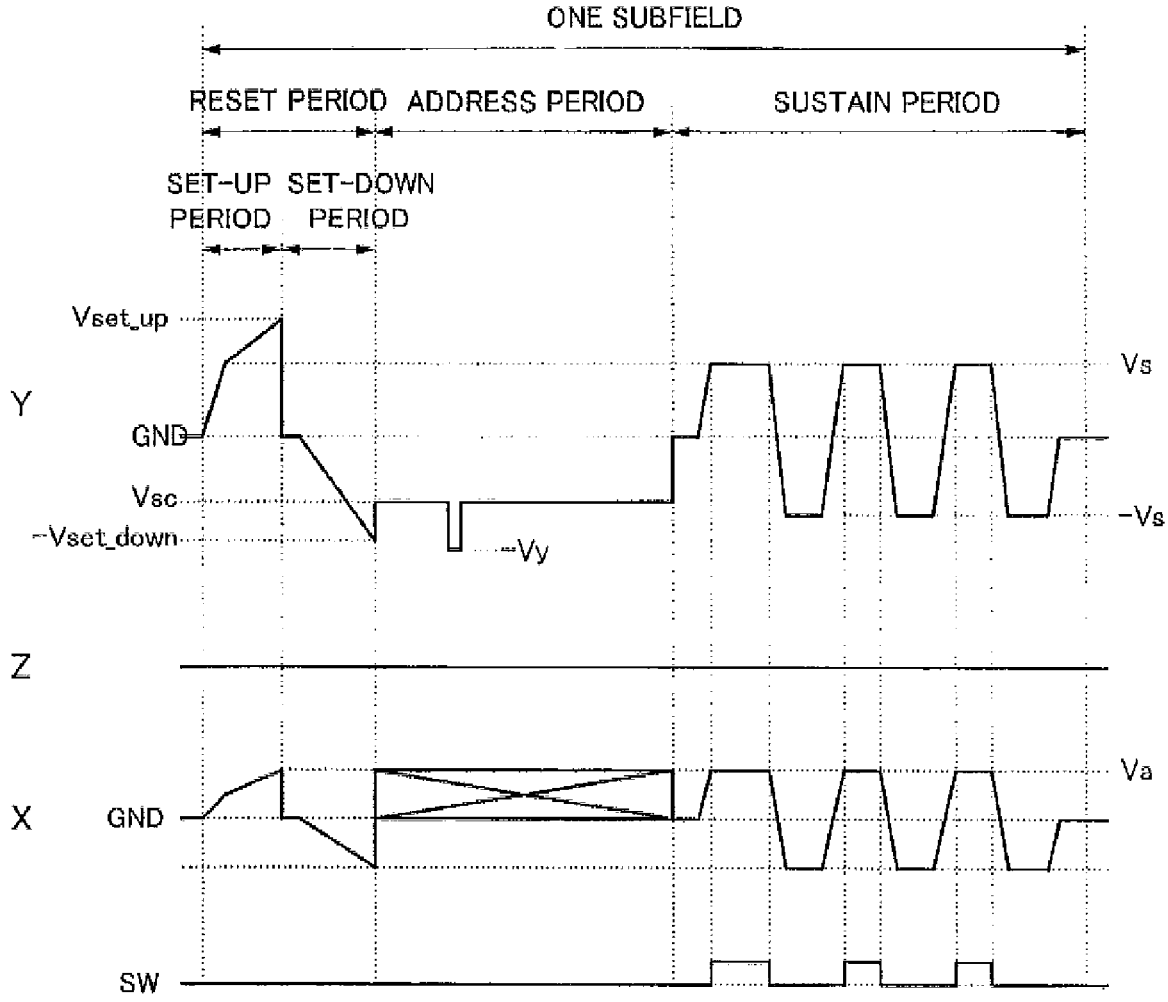

FIG. 7 is a view illustrating a driving waveform of the plasma display apparatus in accordance with a second embodiment of this document.

Referring to FIG. 7, the ground controller can control the first ground unit of the scan electrode Y and the sustain electrode Z and the second ground unit of the address electrode X to be electrically separated from each other in at least one of the reset period and the address period of a subfield. For example, the ground unit can be separated according to the switching operation of the switch element SW of the ground controller.

According to a second embodiment of this document, in the reset period and the address period of the subfield, the first ground unit and the second ground unit can be separated from each other by turning off the switch element SW of the ground controller. At this time, since the address electrode X becomes a floating state, damage to the address electrode X can be minimized. In other words, if a rest waveform is supplied to the scan electrode Y, a waveform having a similar shape to that of the rest waveform is also supplied to the address electrode X, thus minimizing the influence of a voltage shift.

Furthermore, in a period where the positive sustain voltage Vs is applied, of the sustain period of the subfield, the switch element SW of the ground controller can be turned on, so that the first ground unit of the scan electrode Y and the sustain electrode Z is connected to the second ground unit of the address electrode X. In the remaining sustain periods, the switch element SW of the ground controller can be turned off, so that the first ground unit is separated from the second ground unit. If the address electrode X is selectively floated in the sustain period as described above, the waveform of the address electrode X becomes a waveform similar to the sustain waveform.

In other words, as if the positive sustain voltage Vs and the negative sustain voltage −Vs of the scan electrode Y are alternately applied, the waveform of the address electrode X also has the shape of a waveform in which a positive voltage and a negative voltage are alternately applied on the basis of a predetermined reference voltage.

At this time, in the sustain period, the highest value of the waveform induced to the address electrode X is substantially the same as the highest value of the data voltage Va. In other words, a voltage of the floated address electrode X is changed in response to a voltage shift of neighboring electrodes. At this time, a voltage higher than the data voltage is precluded by the data voltage supply unit 520. Accordingly, the voltage rises up to only the data voltage Va induced to the address electrode X. As described above, such floating of the address electrode X in the sustain period enables a stabilized surface discharge, and can improve driving margins.

As described above, the influence of a voltage shift can be minimized by floating the address electrode X. That is, the amount of an opposite voltage between the address electrode X and the scan electrode Y can be decreased and an opposite discharge can be reduced accordingly. Furthermore, a stabilized surface discharge can be generated and black luminance of the reset period can be lowered, thus improving contrast characteristics. In addition, since damage to the address electrode X can be prevented, the lifespan of phosphors can be extended and afterimages can also be improved.

Figure 8:
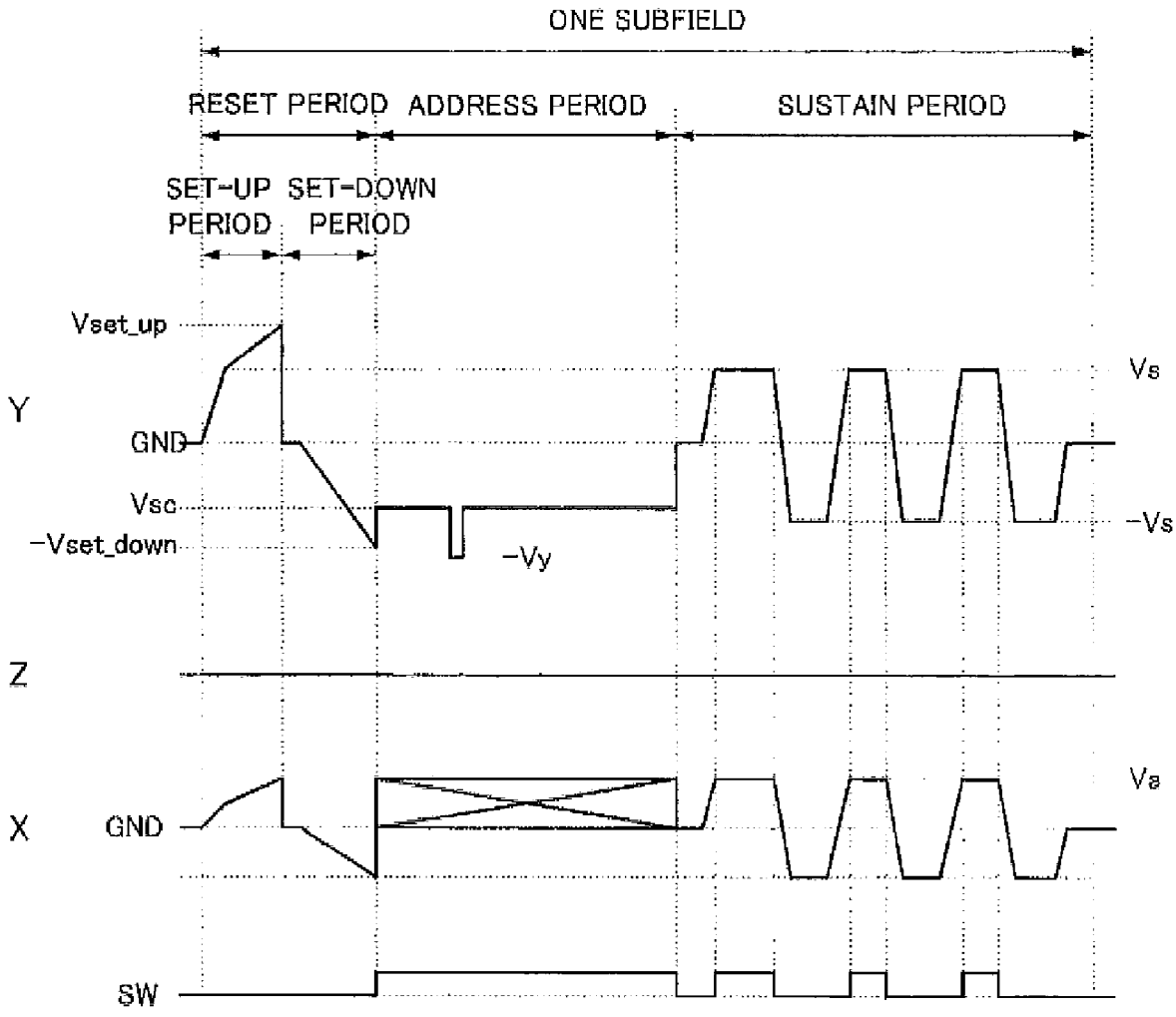

FIG. 8 is a view illustrating a driving waveform of the plasma display apparatus in accordance with a third embodiment of this document.

Referring to FIG. 8, the ground controller can control the first ground unit of the scan electrode Y and the sustain electrode Z and the second ground unit of the address electrode X to be electrically separated from each other in at least one of the reset period and the address period of a subfield. For example, the ground unit can be separated according to the switching operation of the switch element SW of the ground controller.

According to a third embodiment of this document, in the reset period of the subfield, the first ground unit and the second ground unit can be separated from each other by turning off the switch element SW of the ground controller. At this time, since the address electrode X becomes a floating state, damage to the address electrode X can be minimized. In other words, if a rest waveform is supplied to the scan electrode Y, a waveform having a similar shape to that of the rest waveform is also supplied to the address electrode X, thus minimizing the influence of a voltage shift.

Furthermore, in a period where the positive sustain voltage Vs is applied, of the address period and the sustain period of the subfield, the switch element SW of the ground controller can be turned on, so that the first ground unit of the scan electrode Y and the sustain electrode Z is connected to the second ground unit of the address electrode X. Thus, the ground unit of the sustain electrode Z and the ground unit of the address electrode X can be used commonly. In the remaining sustain periods, the switch element SW of the ground controller can be turned off, so that the first ground unit is separated from the second ground unit. If the address electrode X is selectively floated in the sustain period as described above, the waveform of the address electrode X becomes a waveform similar to the sustain waveform.

In other words, as if the positive sustain voltage Vs and the negative sustain voltage −Vs of the scan electrode Y are alternately applied, the waveform of the address electrode X also has the shape of a waveform in which a positive voltage and a negative voltage are alternately applied on the basis of a predetermined reference voltage.

At this time, in the sustain period, the highest value of the waveform induced to the address electrode X is substantially the same as the highest value of the data voltage Va. In other words, a voltage of the floated address electrode X is changed in response to a voltage shift of neighboring electrodes. At this time, a voltage higher than the data voltage is precluded by the data voltage supply unit 520. Accordingly, the voltage rises up to only the data voltage Va induced to the address electrode X. As described above, such floating of the address electrode X in the sustain period enables a stabilized surface discharge, and can improve driving margins.

As described above, the influence of a voltage shift can be minimized by floating the address electrode X. That is, the amount of an opposite voltage between the address electrode X and the scan electrode Y can be decreased and an opposite discharge can be reduced accordingly. Furthermore, a stabilized surface discharge can be generated and black luminance of the reset period can be lowered, thus improving contrast characteristics. In addition, since damage to the address electrode X can be prevented, the lifespan of phosphors can be extended and afterimages can also be improved.

Figure 9:
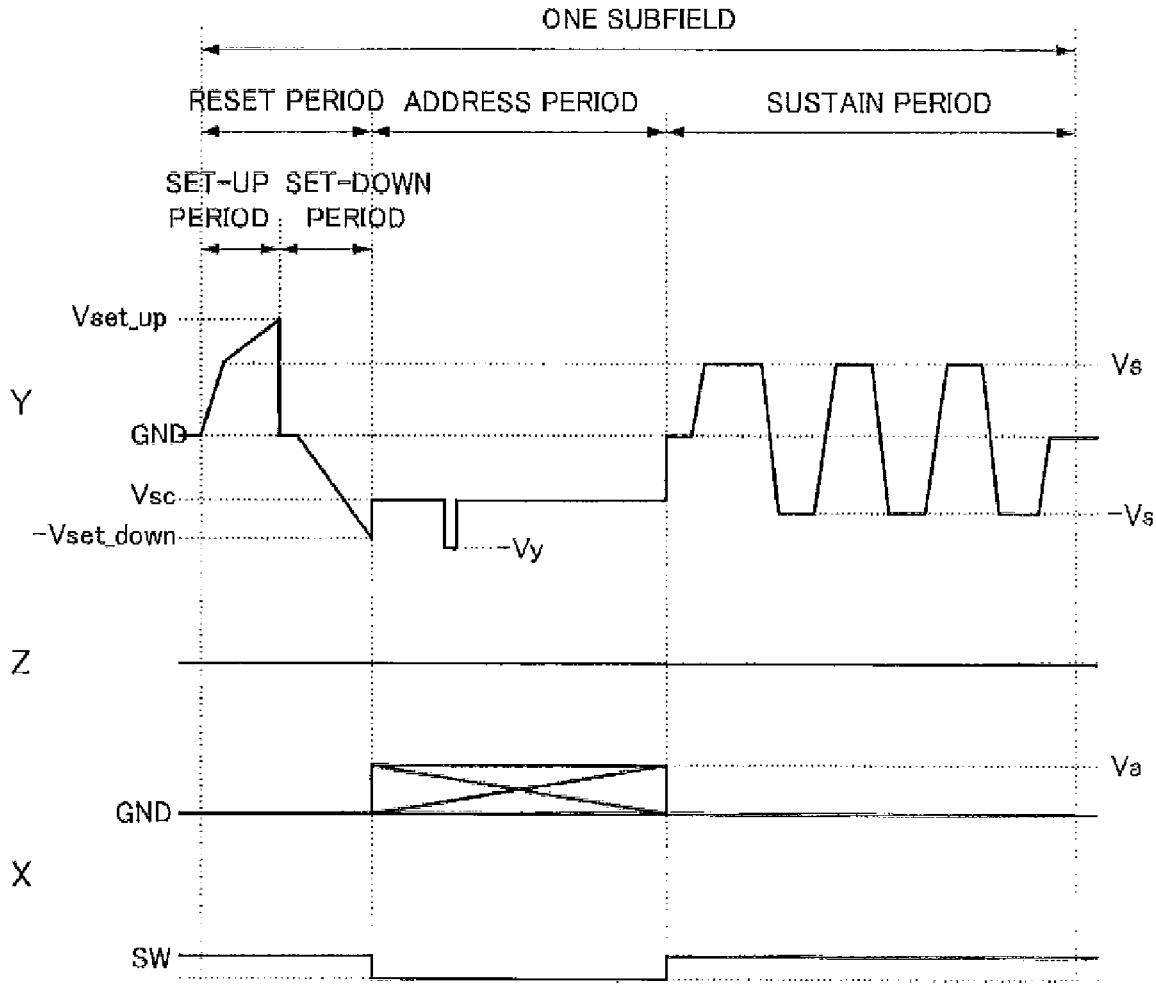

FIG. 9 is a view illustrating a driving waveform of the plasma display apparatus in accordance with a fourth embodiment of this document.

Referring to FIG. 9, the ground controller can control the first ground unit of the scan electrode Y and the sustain electrode Z and the second ground unit of the address electrode X to be electrically separated from each other in at least one of the reset period and the address period of a subfield for a predetermined period. For example, the ground unit can be separated according to the switching operation of the switch element SW of the ground controller.

According to a fourth embodiment of this document, in the address period of the subfield, the first ground unit and the second ground unit can be separated from each other by turning off the switch element SW of the ground controller. At this time, the address electrode X becomes a floating state, minimizing damage to the address electrode X.

Further, in the reset period and the sustain period of the subfield, the switch element SW of the ground controller is turned on to connect the first ground unit and the second ground unit, so that the ground unit of the sustain electrode Z and the ground unit of the address electrode X can be used commonly.

As described above, if the address electrode X is floated, the influence of a voltage shift can be minimized. Accordingly, there are advantages in that a stabilized discharge is enabled and driving efficiency can be improved. It is therefore possible to improve the accuracy of driving through a more accurate address discharge.

Furthermore, this document is not limited to the above embodiments, but the reset period can be divided into a set-up period and a set-down period and the address electrode X can be floated by separating the ground units. That is, in any one of the set-up period and the set-down period, the address electrode X can be floated.

As described above, the plasma display apparatus in accordance with this document is advantageous in that it can improve driving characteristics.

Furthermore, the plasma display apparatus in accordance with this document is advantageous in that it can generate a stabilized discharge.

Further, the plasma display apparatus in accordance with this document is advantageous in that it can lower black luminance and improve contrast characteristics.

In addition, the plasma display apparatus in accordance with this document is advantageous in that it can improve driving margins.

Embodiments of this document being thus described, it will be obvious that the same may be varied in many ways.

Such variations are not to be regarded as a departure from the scope of the invention, and all such modifications as would be obvious to one skilled in the art are intended to be included within the scope of the following claims.

What is claimed is:

1. A plasma display apparatus comprising:

a plasma display panel comprising a scan electrode and a sustain electrode, and an address electrode to intersect the scan electrode and the sustain electrode;

an integrated driver for supplying the scan electrode or the sustain electrode with a sustain voltage;

a data driver for supplying the address electrode with a data voltage;

a first ground unit for grounding the integrated driver and the sustain electrode;

a second ground unit for grounding the data driver; and a ground controller for controlling the first ground unit and the second ground unit to be electrically separated from each other for a predetermined period in at least one of a reset period and an address period of a subfield.

2. The plasma display apparatus of claim 1, wherein the integrated driver has one end connected to the scan electrode and the other end commonly connected to the first ground unit, the sustain electrode, and one end of the ground controller.

3. The plasma display apparatus of claim 1, wherein the data driver has one end connected to the address electrode and the other end commonly connected to the second ground unit and the other end of the ground controller.

4. The plasma display apparatus of claim 1, wherein the ground controller has one end commonly connected to the other end of the integrated driver, the first ground unit, and the sustain electrode, and the other end connected to the second ground unit, the other end of a bottom switch of the data driver, and the other end of a data voltage supply unit of the data driver.

5. The plasma display apparatus of claim 4, wherein the ground controller comprises a switch element, and a parasitic capacitor that is generated by the switch element.

6. The plasma display apparatus of claim 5, wherein the switch element comprises two switch elements having body diodes.

7. The plasma display apparatus of claim 6, wherein the body diodes have anodes or cathodes connected to each other.

8. The plasma display apparatus of claim 1, wherein the ground controller is turned off for a predetermined period in the reset period of the subfield, so that the first ground unit is separated from the second ground unit.

9. The plasma display apparatus of claim 8, wherein the ground controller is turned on for a predetermined period in the address period and the sustain period of the subfield, so that the first ground unit and the second ground unit are connected to each other.

10. The plasma display apparatus of claim 8, wherein in the reset period, a waveform of the address electrode is similar to a rest waveform of the scan electrode.

11. The plasma display apparatus of claim 10, wherein in the reset period, a highest value of the waveform of the address electrode is substantially the same as that of the data voltage.

12. The plasma display apparatus of claim 8, wherein the ground controller is turned off for a predetermined period in the address period of the subfield, separating the first ground unit and the second ground unit from each other, and the ground controller is turned on in a period where a positive sustain voltage is applied, of the sustain period of the subfield, connecting the first ground unit and the second ground unit, and is turned off in the remaining periods, separating the first ground unit and the second ground unit from each other.

13. The plasma display apparatus of claim 12, wherein in the sustain period, a waveform of the address electrode is similar to a sustain waveform of the scan electrode.

14. The plasma display apparatus of claim 13, wherein in the sustain period, a highest value of the waveform of the address electrode is substantially the same as that of the data voltage.

15. The plasma display apparatus of claim B, wherein the ground controller is turned on in the address period of the subfield, connecting the first ground unit and the second ground unit, and the ground controller is turned on in a period where a positive sustain voltage is applied, of the sustain period of the subfield, connecting the first ground unit and the second ground unit, and is turned off in the remaining periods, separating the first ground unit and the second ground unit from each other.

16. The plasma display apparatus of claim 15, wherein in the sustain period, a waveform of the address electrode is similar to a sustain waveform of the scan electrode.

17. The plasma display apparatus of claim 16, wherein in the sustain period, a highest value of the waveform of the address electrode is substantially the same as that of the data voltage.

18. The plasma display apparatus of claim 1, wherein the ground controller is turned on in the reset period and the sustain period of the subfield, connecting the first ground unit and the second ground unit, and is turned off in the address period of the subfield, separating the first ground unit and the second ground unit from each other.

* * * * *